US006293844B1

(12) United States Patent
Dalton

(10) Patent No.: US 6,293,844 B1
(45) Date of Patent: Sep. 25, 2001

(54) BRASSIERE

(76) Inventor: Diane Dalton, P.O. Box 1352, Corrales, NM (US) 87048

( * ) Notice: Subject to any disclaimer, the term of this patent is extended or adjusted under 35 U.S.C. 154(b) by 0 days.

(21) Appl. No.: 09/523,318

(22) Filed: Mar. 10, 2000

Related U.S. Application Data

(60) Provisional application No. 60/123,956, filed on Mar. 12, 1999.

(51) Int. Cl.[7] ..... A41C 3/00
(52) U.S. Cl. ..... 450/1; 450/88; 450/86
(58) Field of Search ..... 450/1, 62, 86, 450/87, 88, 54, 58, 64

(56) References Cited

U.S. PATENT DOCUMENTS

| | | | |
|---|---|---|---|
| D. 358,247 | | 5/1995 | Nishiba . |
| 2,118,378 | | 5/1938 | Graham . |
| 2,455,036 | | 11/1948 | Boylan . |
| 2,509,353 | * | 5/1950 | Johnson ..... 450/1 |
| 2,753,563 | | 7/1956 | Blitch . |
| 3,027,898 | | 4/1962 | Williams . |
| 3,071,140 | | 1/1963 | Adler . |
| 3,112,750 | | 12/1963 | Jonas . |
| 3,186,412 | | 6/1965 | Kurland . |
| 3,291,132 | | 12/1966 | Puliafico . |
| 3,465,754 | | 9/1969 | Lockwood et al. . |
| 4,220,157 | | 9/1980 | Clark et al. . |
| 4,311,150 | | 1/1982 | Schreiber et al. . |
| 5,244,432 | | 9/1993 | Moy Au et al. . |

* cited by examiner

*Primary Examiner*—Gloria M. Hale
(74) *Attorney, Agent, or Firm*—Brian J. Pangrle; Jeffrey D. Myers

(57) ABSTRACT

A brassiere comprising features which improve comfort of wear.

8 Claims, 10 Drawing Sheets

1
1'
4
4'
3
2
2'

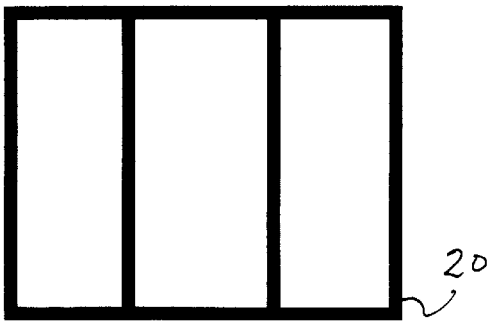
FIG. 8
FIG. 8a
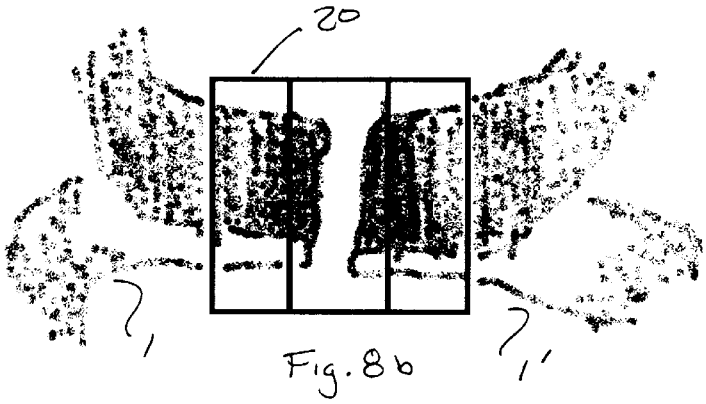
Fig. 8b
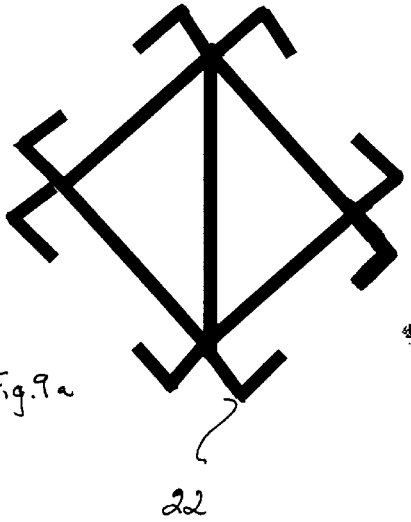
Fig. 9a
FIG. 9
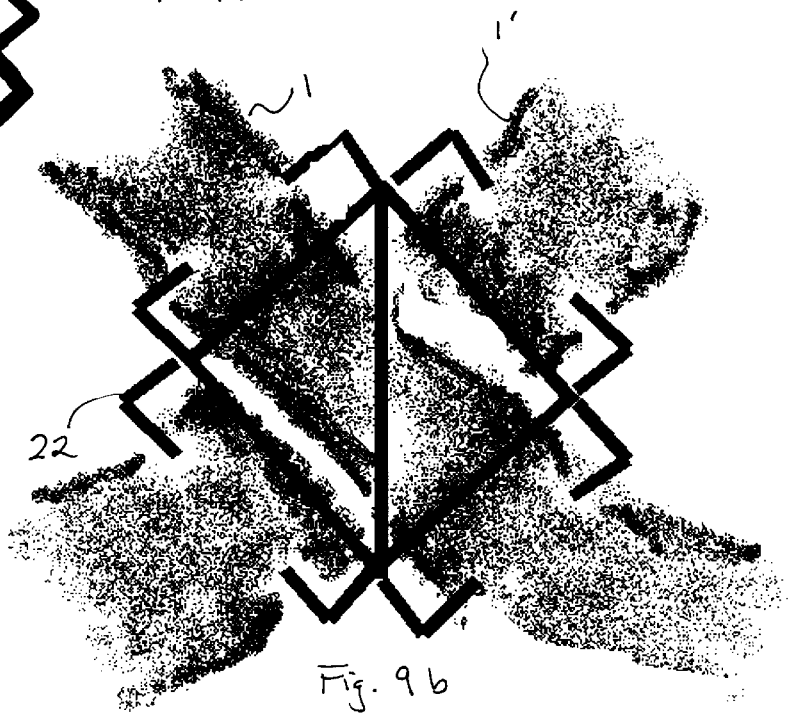
Fig. 9b 61
61'
64
64'
63
61'
61

BRASSIERE

CROSS-REFERENCE TO RELATED APPLICATIONS

This application claims the benefit of the filing of U.S. Provisional Patent Application Ser. No. 60/123,956, entitled "Brassiere", to Diane Dalton, filed on Mar. 12, 1999 and the specification thereof is incorporated herein be reference.

COPYRIGHTED MATERIAL

A portion of the disclosure of this patent document contains material that is subject to copyright protection. The owner has no objection to the facsimile reproduction by anyone of the patent document or the patent disclosure, as it appears in the Patent and Trademark Office patent file or records, but otherwise reserves all copyrights whatsoever.

BACKGROUND OF THE INVENTION

1. Field of the Invention

The present invention relates to brassieres and more specifically to new features that improve comfort of wear.

2. Background

It is desirable to construct a brassiere that does not include a ribcage-encircling band or other features that constrict and bind the wearer causing discomfort.

The following U.S. patents disclose brassieres:

U.S. Pat. No. 5,244,432, entitled *Protective and Supportive Brassiere*, to Moy Au et al., issued Sept. 14, 1993 discloses a brassiere having shock absorbing cups and a body band. 1982 discloses a brassiere consisting of a wide, circular, elastic rib band, at least one front panel and at least one side panel of material. U.S. Pat. No. 4,220,157, entitled *Counterweighted Brassiere for Athletic Use*, to Clark et al., issued Sep. 2, 1980 discloses a brassiere that uses suspended weights to lift breast cups. U.S. Pat. No. 3,465,754, entitled *Brassiere*, to Lockwood et al., issued Sept. 9, 1969 discloses a brassiere that has no direct frontal connection between breast cups. U.S. Pat. No. 3,291,132, entitled *Self-Positioning Brassiere*, to Puliafico, issued Dec. 13, 1966 discloses a brassiere having a pair of cups, back bands, tape-like members and triangular connecting members for each cup that connect three individual bands. U.S. Pat. No. 3,186,412, entitled *Brassiere with Elastic Support Tapes*, to Kurland, issued Jun. 1, 1965 discloses a brassiere having a pair of body encircling bands, each connected along an outer perimeter of a breast cup. U.S. Pat. No. 3,112,750, entitled *Garment Having Adjustable Plastic Buckle*, to Jonas, issued Dec. 3, 1963 discloses a brassiere having an adjustable plastic bucket positioned at the top of each breast cup. U.S. Pat. No. 3,071,140, entitled *Brassiere*, to Adler, issued Jan. 1, 1963 discloses a brassiere having two straps, a strap extending from the outer side of each cup, having converging edges; the straps cross at a non-adjustable, fixed position on the wearer's back. U.S. Pat. No. 3,027,898, entitled *Self-Adjusting Posture Improvement Attachment for Brassieres*, to Williams, issued Apr. 3, 1962 discloses a posture improvement attachment for a brassiere. U.S. Pat. No. 2,753,563, entitled *Brassiere*, to Blitch, issued Jul. 10, 1956 discloses a brassiere having a pair of bands, each band having a semi-circular opening in the upper edge thereof. U.S. Pat. No. 2,455,036, entitled *Brassiere*, to Boylan, issued Nov. 30, 1948 discloses a brassiere having a circular shaped connector for free sliding of two back-crossing straps during wear. U.S. Pat. No. 2,118,378, entitled *Suspension Strap*, to Graham, issued May 24, 1938 discloses a shoulder strap suspension for garments having a fixed back-crossing connection. U.S. Pat. No. Des. 358,247, entitled *Brassiere*, to Nishiba, issued May 16, 1995 discloses a brassiere having straps that do not cross on the wearer's backside.

SUMMARY OF THE INVENTION (DISCLOSURE OF THE INVENTION)

The present invention comprises a brassiere comprising at least one strap and two breast cups. In a preferred embodiment, the present invention comprises one strap comprising a two-loop figure eight pattern wherein each loop comprises an outer circumference and an inner circumference adjacent to a point where the strap crosses itself and where the wearer's arms are inserted one through each loop of the figure eight pattern and two breast cups wherein each breast cup comprises an outer perimeter and wherein each of the breast cup outer perimeters are attached to the strap at a position along the loop outer circumference and/or the loop inner circumference. In this embodiment, the brassiere optionally comprises fasteners, underwires, connectors and/or adjustors. In this embodiment, the brassiere optionally comprises at least one interruption of the strap and bridging of the at least one interruption by at least one connector. This embodiment optionally further comprises two additional straps attached along the outer perimeter of the breast cups.

In a preferred embodiment, the present invention comprises two breast cups where each breast cup comprises an outer perimeter and two straps wherein each strap attaches along an outer perimeter of a breast cup, extends over a shoulder of the wearer, crosses the other strap at a point on the backside of the wearer, passes under the arm of the wearer, and attaches to a point along the outer perimeter of the other breast cup. This embodiment optionally comprises fasteners, underwires, connectors and/or adjustors. This embodiment optionally comprises at least one interruption of at least one of the straps and bridging of the at least one interruption by at least one connector.

In a preferred embodiment, the present invention comprises two breast cups where each breast cup comprises an outer perimeter and two straps where each strap attaches along an outer perimeter of a breast cup, extends over a shoulder of the wearer, crosses the other strap at a point on the backside of the wearer, passes under the arm of the wearer, and attaches to the other strap at a point adjacent to the outer perimeter of the other breast cup. This embodiment optionally comprises fasteners, underwires, connectors and/or adjustors. This embodiment optionally comprises at least one interruption of at least one of the straps and bridging of the at least one interruption by at least one connector.

In a preferred embodiment, the present invention comprises two breast cups, straps where the straps form an "X" pattern across the wearer's backside where the "X" pattern comprises internal angles, and a connector for wearer selection of and/or adjustment of and fixing of the internal angles of the "X" pattern. According to this embodiment, the connector is adjustable, selectable, and/or fixable by the wearer. According to the present invention, a brassiere comprising at least one connector that provides for a selectable and/or adjustable and fixable "X" pattern also provides for increased wearer comfort. According to the present invention, such connectors comprise, for example, natural, synthetic, and/or natural and synthetic materials. In a preferred embodiment, the connector comprises a mechanism, such as a snap, that allows for user adjustment and/or selection and fixation of "X" pattern and/or "X" intersection internal angles. In an alternative embodiment, the connector comprises a piece of material comprising an "X" pattern and/or "X" intersection comprising fixed internal angles that is connectable to at least one strap.

A primary object of the present invention is to provide a brassiere construction that does not rely on discomforting features while still providing adequate support.

A primary advantage of the present invention is comfortable wear.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings:

FIG. 8*a* is an enlarged plan view of a connector element useable with a preferred embodiment of the brassiere of the present invention;

FIG. 8*b* is a plan view of the connector element of FIG. 8*a*, showing strap elements disposed therethrough;

FIG. 9*a* is an enlarged plan view of another connector element useable with a preferred embodiment of the brassiere of the present invention;

FIG. 9*b* is a plan view of the connector of FIG. 9*a*, showing strap elements disposed therethrough;

DESCRIPTION OF THE PREFERRED EMBODIMENTS

BEST MODES FOR CARRYING OUT THE INVENTION

Figure 1:
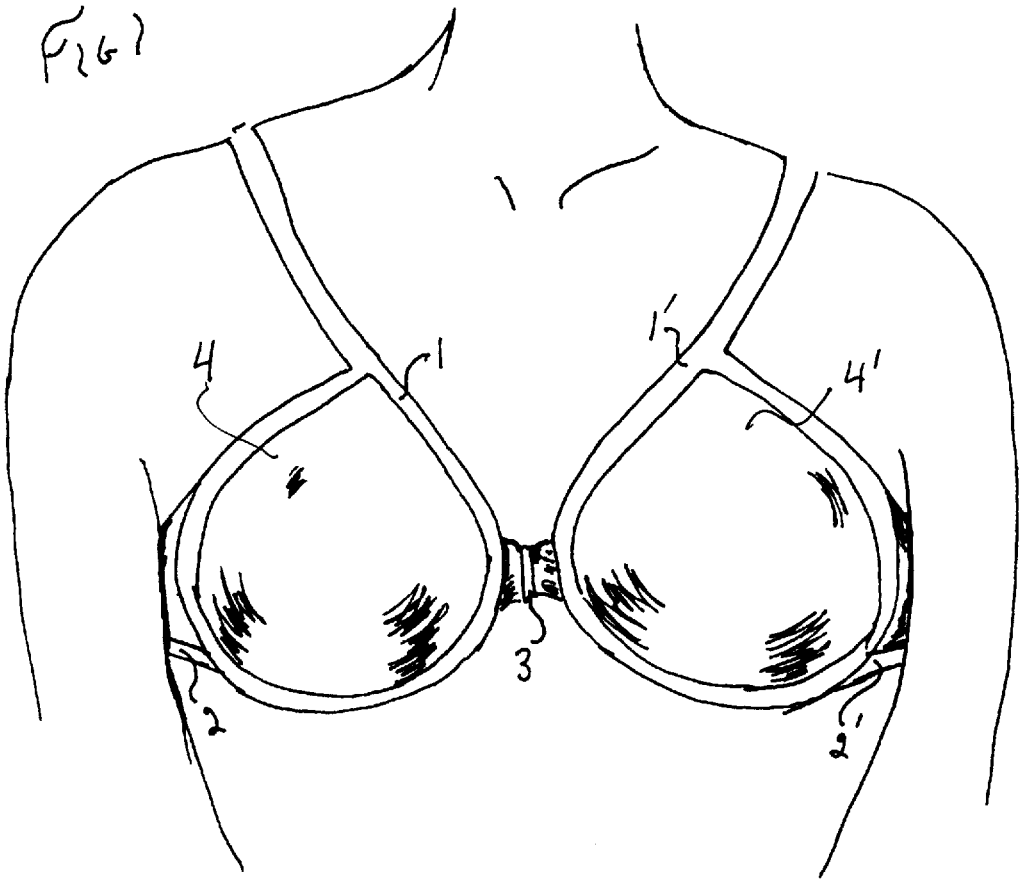
FIG. 1 is a front view of a preferred embodiment of the brassiere of the present invention, worn by a user.

The brassiere of the present invention comprises at least one strap and at least two breast cups. The present invention optionally comprises at least one connector for connecting and/or adjusting straps. In a preferred embodiment, the brassiere comprises a single loop-forming strap and two breast cups that are attached to the strap. In this single strap embodiment, the strap crosses itself on either the wearer's front side, backside, or both front and back sides. In a preferred embodiment of the single strap brassiere, the brassiere comprises a connector for connecting the strap to itself at a point on the wearer's backside, front side, or both front and back sides. In one-strap embodiments of the present invention, the strap substantially forms a two-loop figure eight pattern wherein the wearer's arms are inserted one through each loop of the figure eight pattern. In this embodiment, one strap comprises a two-loop figure eight pattern wherein each loop comprises an outer circumference and an inner circumference adjacent to a point where the strap crosses itself. Again, as described, the loops are optionally interlocked, open, and/or connected with a connector.

The present invention comprises breast cups where each breast cup comprises an outer perimeter and wherein each breast cup outer perimeter is at some point attached to a strap. For example, in a one-strap embodiment, breast cup attachment is at a position along the loop outer circumference and/or along the loop inner circumference.

In an alternative preferred embodiment, the brassiere comprises two straps and two breast cups. In this two strap embodiment, each strap starts at or near the top of a breast cup, encircles the breast cup, passes over a shoulder of the wearer and ends at a juncture with the other breast cup and/or strap at or near the lower and outer edge of the same or opposing breast cup.

In yet an alternative preferred embodiment, the brassiere comprises three straps, a single strap as described in the single strap embodiment and two additional straps, one on each breast cup, that follow an outer portion of the circumference of each breast cup. In still another alternative embodiment, connectors are used and the strap and/or straps, as described above, are interrupted, thereby forming a bra comprising a plurality of straps. For example, interruption of the strap of the aforementioned single strap embodiment at points above the breast cups and below the tops of the wearer's shoulders effectively create a two strap brassiere wherein the two straps are connected by connectors that bridge the two interruptions. It is within the scope of the present invention to alter the aforementioned preferred embodiments with a plurality of interruptions that are bridged with connectors.

According to the present invention, a strap comprises a material comprising, for example, but not limited to, a rectangular and/or circular cross-section. Materials used in construction of brassieres known to one of ordinary skill in the art are suitable for use as straps. Such materials include, for example, elastic and inelastic materials. In a preferred embodiment of the present invention, straps comprise elastic. In a preferred embodiment of the present invention, the brassiere comprises at least one wire following a partial or total circumference of at least one breast cup. Wire is understood to include metal, plastic, natural and other suitable material. Wire comprising spring coils and/or spring-like characteristics is considered within the scope of the present invention. The main purpose of the wire, as used herein, is to provide support to a wearer's breast as it sits in a breast cup. In a preferred embodiment of the present invention, wire follows a portion of the breast cup circumference while at least one elastic strap follows the remainder of the circumference. It is understood that wire is insertable and/or attachable to a strap and that such a strap optionally comprises elastic and/or inelastic properties. In another preferred embodiment of the present invention, the brassiere comprises a section of strap that passes over the wearer's shoulder comprising a greater width, and/or diameter, than other sections of strap. The purpose of the wider section of strap is to reduce pressure on the wearer's shoulder—the wider section of strap optionally increases or decreases frictional forces with the wearer's skin.

According to the present invention, breast cups comprise material known in the art, preferably formable material. Such material includes, but is not limited to, natural, synthetic, and blends of natural and synthetic materials. Materials sold under the trademark LYCRA® (E.I. du Pont de Nemours, Wilmington, Del.) are suitable.

According to the present invention, the brassiere optionally comprises connectors for connecting and/or adjusting straps. Connectors are placeable at a variety of points. For example, a connector positioned above the breast cup provides for strap adjustment. Connectors are also positionable on the backside of the brassiere. For example, the aforementioned single and triple strap embodiments of the present invention were described in absence of connectors. Connectors are useful for bridging interruptions in straps, joining straps and/or for connecting one or more sections of a strap back to the strap itself. In the aforementioned embodiments, the single strap (or main strap of the three-strap brassiere) optionally crosses, or intersects, to form a substantial "X" pattern across the wearer's back. Alternatively, the single strap comprises a connection to itself without crossing while still comprising an "X" pattern, also referred to as an "X" intersection herein. In the double strap embodiment, the two straps also form a substantial "X" pattern across the wearer's back. The point of crossing, or connection, is referred to herein as the "X" intersection. The "X" pattern formed by the at least one strap also comprises internal angles that further comprise left side and right side angles and upper and lower angles. In preferred embodiments of the present invention, the left side and right side angles are approximately equal and the upper and lower angles are approximately equal. In all of the aforementioned embodiments, the strap, or straps, are interruptible at positions at the "X", above the "X", and below the "X". Interruptions are bridged through use of connectors. Alternatively, the brassiere of the present invention optionally comprises adjusters that do not require interruption or severing of a strap. Such adjusters typically require folding over of a strap or rolling/coiling of a strap to effectuate an adjustment to strap length. Connectors commonly used in the art of brassieres are suitable for achieving connection of straps, adjustment of a strap or straps, and a combination of adjustment and connection.

In a preferred embodiment of the brassiere of the present invention, at least one "X" connector and/or at least one adjuster is positionable at the aforementioned intersection of the "X" pattern. The use of such a connector and/or adjuster helps to prevent upward creep of the brassiere. In particular, a connector or adjuster that locks the internal angles of the "X" pattern helps to prevent upward creep of the brassiere. In a preferred embodiment, the brassiere of the present invention comprises at least one connector and/or at least one adjuster that locks the internal angles of the "X" pattern. Connectors that, for example, replace the "X" intersection are suitable for use if they also comprise a mechanism for locking the internal angles of the "X" pattern. It is understood that replacement of the "X" intersection with a connector may render a pattern that does not comprise an "X" at the very center; however, an "X" pattern is still present on the wearer's backside formed by the crossing of shoulder straps and side straps. It is understood that in embodiments comprising connectors, connectors optionally connect sides of straps and/or ends of straps. Thus, end-to-end, side-to-side, and/or front-to-back connections are possible and within the scope of the present invention.

EXAMPLES

FIG. 1 is a front view of a preferred embodiment of the brassiere of the present invention. This embodiment comprises connectors and four straps. As shown in FIG. 1, the brassiere comprises front straps 1, 1', side straps 2, 2', a front connector 3, and breast cups 4, 4'. Near the top of the breast cups 4, 4' each front strap 1, 1' encircles a breast cup, follows a path along the outside circumference, or perimeter, of the breast cup to a point near the underarm, where a side straps 2, 2' adjoins. Each front strap 1, 1' continues along the lower perimeter of the cup to a front connector 3 point between the breast cups 4, 4' and continues up to and over a same-side shoulder. In this preferred embodiment, straps 1, 1' optionally comprise underwire beneath at least a portion of each breast cup 4, 4'.

Figure 2:
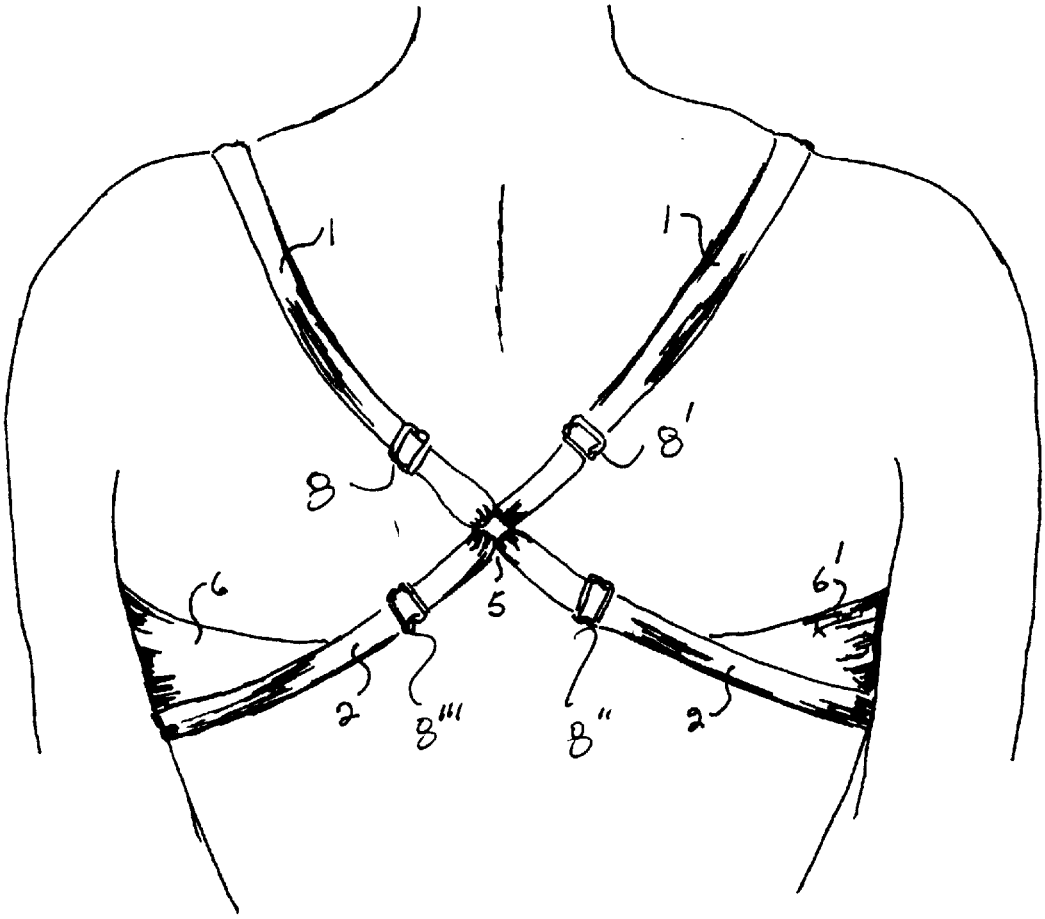
FIG. 2 is a rear view of the embodiment of the brassiere of the present invention shown in FIG. 1.

FIG. 2 shows a backside view of the preferred embodiment of FIG. 1. As shown in FIG. 2, straps 1, 1' continue down from the wearer's shoulders to an "X" intersection 5. The "X" intersection 5 comprises a connector for connecting the front straps 1, 1' and the side straps 2, 2'. This embodiment comprises adjusters 8, 8', 8", 8'". These adjusters are positioned two above the "X" intersection 8, 8' and two below the "X" intersection 8", 8'". Each side strap 2, 2' extends from the "X" intersection under an arm of the wearer and continues, as shown in FIG. 1, to a meeting point with a respective front strap 1, 1'. This particular embodiment also comprises side material 6, 6'. Side material, also referred to as a "side wing," comprises, for example, breast cup material and the like.

Regarding the embodiment shown in FIGS. 1 and 2, front fastener and underwire are not shown and a variety of fastener and underwire components known in the art of brassieres are suitable for use in the present invention. Fasteners are, in general, primarily for facilitating putting on and taking off of a brassiere whereas connectors are, in general, primarily for connecting straps, as described herein. Some fasteners known in the art of sewing are suitable as connectors and some connectors known in the art of sewing are suitable as fasteners. Furthermore, sewing details of breast cups and their attachment to straps are not shown and a variety of stitching arrangements known in the art of brassieres are suitable for use in the present invention. The present invention is adaptable for a variety of cup constructs. For example, the present invention can adapt to various strengthening inserts sewn into the cup or attached to the strap sewn beneath the cup, or various cup constructs including circular knit fabric, molded fabric or non elastic fabric sewn to the cup shape. Breast cups designed for nursing mothers are also adaptable to the present invention. Incorporation of nursing cups having means for exposing a nipple comprises part of a preferred embodiment of the present invention. A preferred embodiment of the present invention comprising nursing cups having means for exposing a nipple further comprises fit adjustment means.

Figure 3:
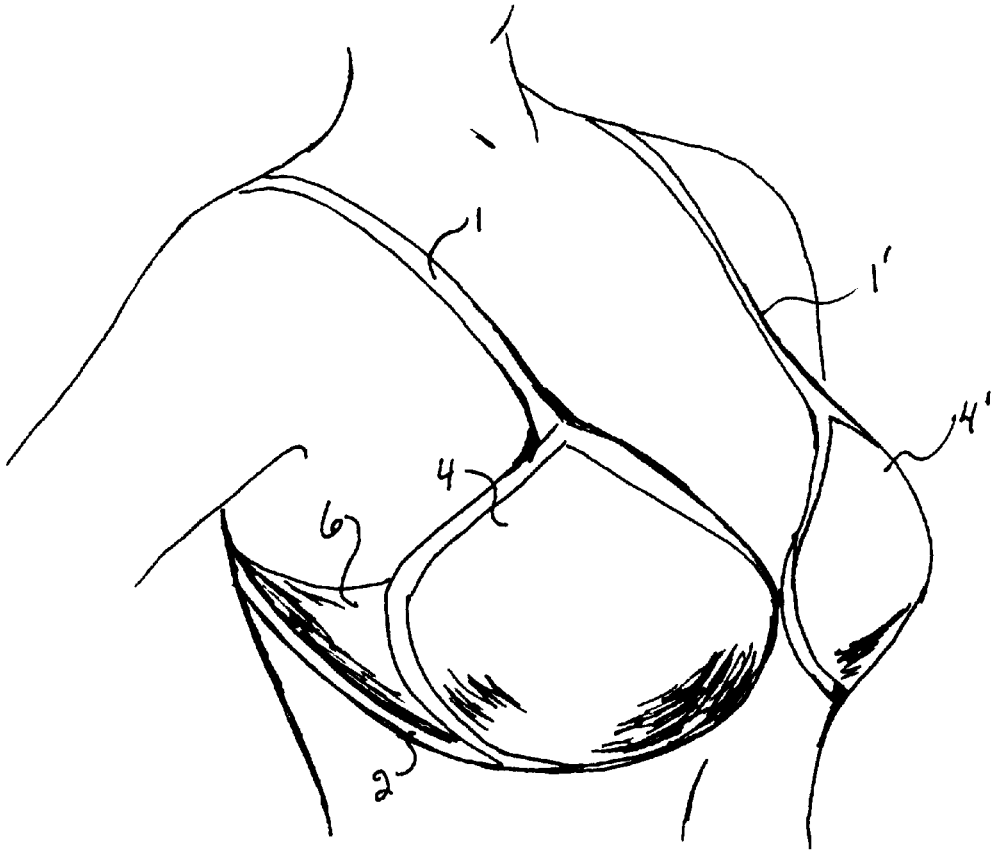
FIG. 3 is a perspective side view of the embodiment of the brassiere of the present invention shown in FIG. 1.

FIG. 3 is a perspective view of a preferred embodiment of the brassiere of the present invention. FIG. 3 shows breast cups 4, 4', a side wing 6, straps 1, 1' that encircle the breast cups. A side strap 2 joins front strap 1 just below the breast. Front strap 1 and side strap 2 are joinable by a variety of methods and techniques known in the art, for example, in a preferred embodiment the two straps may overlap.

Figure 4:
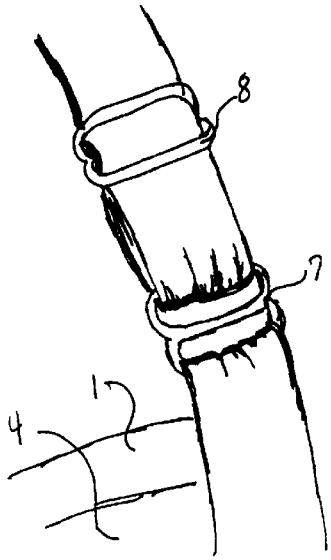
FIG. 4 is an enlarged view of adjuster and connector elements of a preferred embodiment of the brassiere of the present invention.

FIG. 4 shows a preferred embodiment of the present invention where at least one strap, such as a front strap 1, has at least one length adjuster 8 and connector 7. In a preferred embodiment, at least one strap adjuster 8 is placed at a point above where the front strap's 1 attaches to itself at the upper edge of a breast cup 4. In a preferred embodiment, an adjuster comprises a slide 8 to help fit a particular wearer's body.

Figure 5:
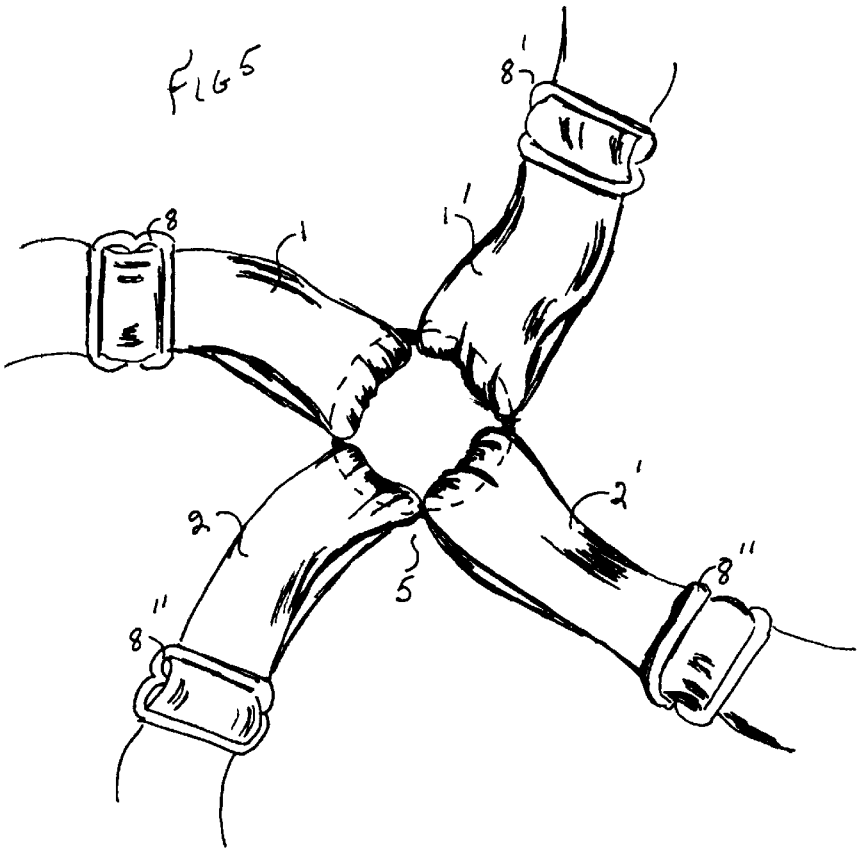
FIG. 5 is an enlarged view other connector elements of a preferred embodiment of the brassiere of the present invention.
Figure 6:
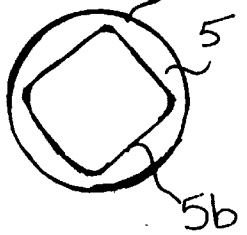
FIG. 6 is an enlarged plan view a connector element of a preferred embodiment of the brassiere of the present invention.

FIG. 5 shows a connector of a preferred embodiment of the present invention. This connector 5 connects straps 1, 1', 2, 2' at an "X" intersection on the wearer's backside. In this particular embodiment, straps are joined by a ring connector 5 and slides 8, 8', 8" and 8'" that allow the "X" intersection to be moved up or down to fit the particular wearer's body. FIG. 6 shows the connector 5. The connector 5 comprises a substantially circular outer edge 5*a* and a substantially rectangular inner edge 5*b*. The four edges of the rectangular inner edge 5*b* are of sufficient width to accommodate the straps 1, 1', 2, 2'.

Figure 7:
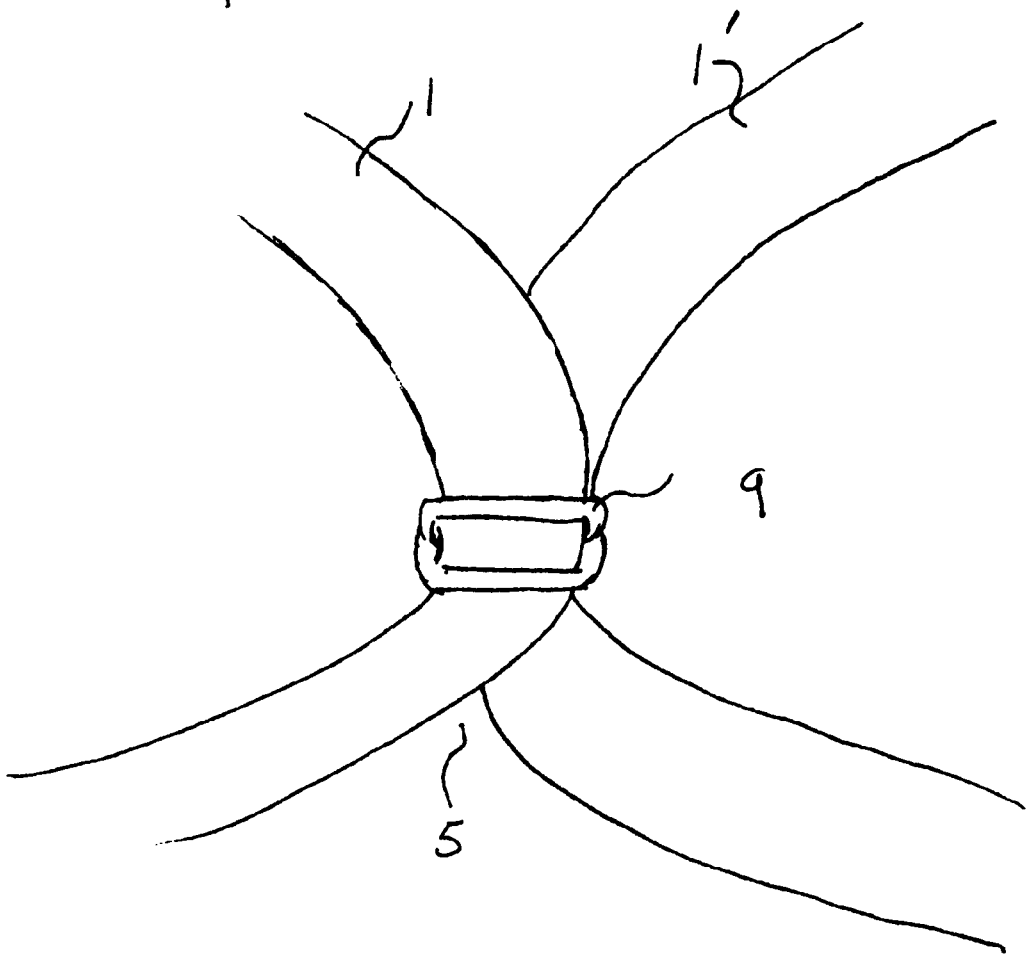
FIG. 7 is a partial view of a preferred embodiment of the brassiere of the present invention showing a connector element thereof.

The connectors shown in FIGS. 7 through 10 are suitable for strap connections at the backside "X" intersection of the wearer. Some of the connectors are suitable for use at other points as well. FIG. 7 shows a connector 9 for connecting two straps 1, 1'. This configuration is suitable for embodiments wherein the straps are not interrupted on the backside at the "X" intersection. The connector 9, as shown in FIG. 7, also allows for adjustment of the position of the "X" intersection, e.g., the "X" intersection is moveable up or down to fit the particular wearer's body. The connector 9, optionally comprises an adjuster 8 as shown in FIG. 4. This connector is also suitable, though not preferred, for strap connection at a point approximately between the breast cups.

FIG. 8*a* shows a connector 20 for connecting two straps 1, 1'. FIG. 8*b* shows the connector 20 and two straps 1, 1'. This configuration is suitable for embodiments wherein the straps are not interrupted on the backside at the "X" intersection. The connector 20, as shown in FIGS. 8*a* and 8*b*, also allows for adjustment of the position of the "X" intersection, e.g., the "X" intersection is moveable up or down to fit the particular wearer's body. In this particular embodiment, the straps 1, 1' do not attach to an opposite side strap and/or breast cup but rather attach to a same side strap and/or breast cup.

FIG. 9*a* shows a connector 22 for connecting two straps 1, 1'. FIG. 9*b* shows the connector 22 and two straps 1, 1'. This configuration is suitable for embodiments wherein the straps are not interrupted on the backside at the "X" intersection. The connector 22, as shown in FIGS. 9*a* and 9*b*, also allows for adjustment of the position of the "X" intersection, e.g., the "X" intersection is moveable up or down to fit the particular wearer's body.

Figure 10:
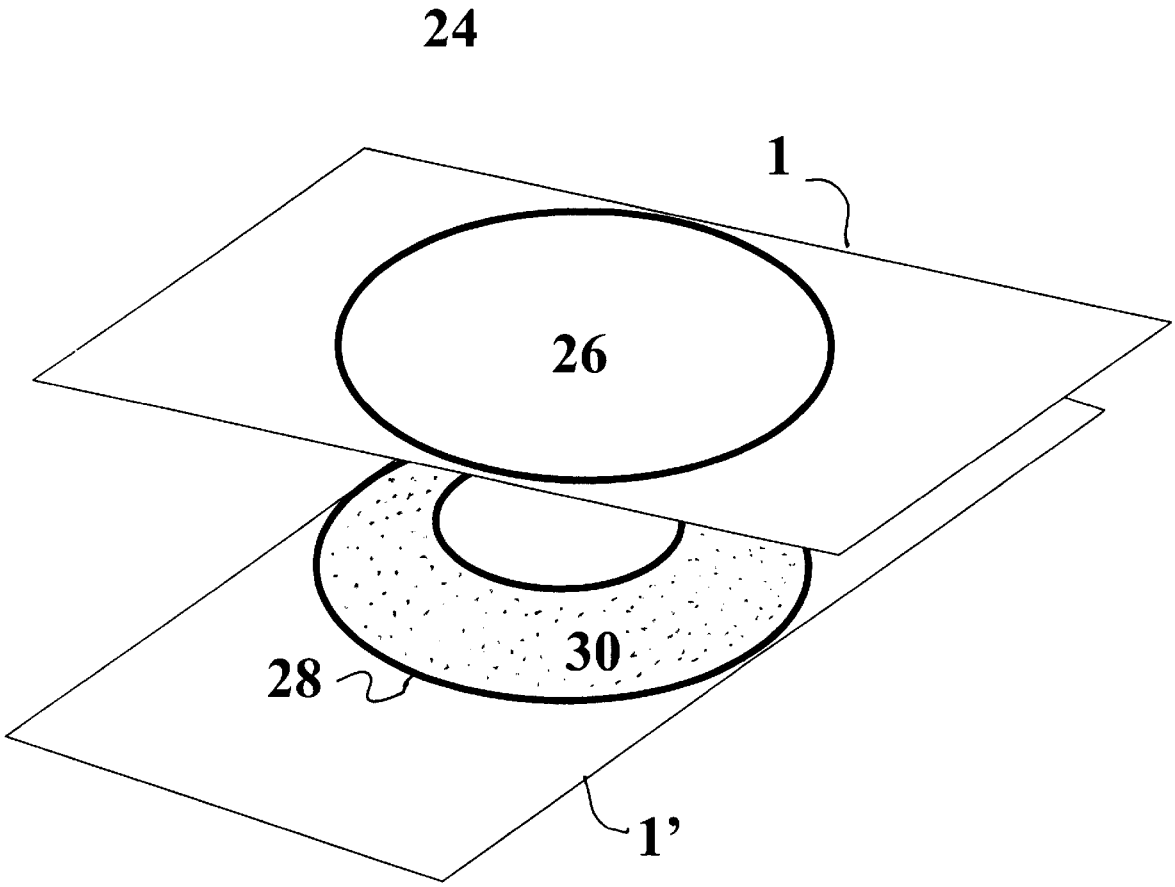
FIG. 10 is an exploded view of another connector element useable with a preferred embodiment of the brassiere of the present invention.

FIG. 10 shows the connector 24 and two straps 1, 1'. As shown in FIG. 10, upper portion 26 and lower portion 28 comprise a snap or snap-like mechanism as described herein. This configuration is suitable for embodiments wherein the straps are not interrupted on the backside at the "X" intersection. The connector 24, as shown in FIG. 10, also allows for adjustment of the internal angles of the "X" intersection and/or up or down adjustments of the "X" intersection to fit the particular wearer's body. As shown in FIG. 10, the connector comprises an upper portion 26 and a lower portion 28. The upper portion is attached to one strap 1 while the lower portion is attached to another strap 1'. The connector 24 comprises an ability to control the internal angles of the "X" intersection. For example, as shown in FIG. 10, the lower portion of the connector 28 optionally comprises surface indicia 30 for increasing friction between the upper portion 26 and lower portion 28. Mechanisms for controlling the internal angles optionally comprise, for example, but not limited to, at least one rough surface, at least one sticky surface, at least one magnetic surface, VELCRO® (Velcro, Inc., Manchester, N.H.), a clamp, a staple, a snap, and the like. Alternatively, the connector 24 comprises radial grooves. For example, a connector comprising a fixed number of equally spaced grooves, such as eight, can adjust the internal angles of the "X" intersection at increments of approximately 45 degress. Of course, connectors of the present invention are not limited to eight grooves or equally spaced grooves. In an alternative embodiment, the "X" intersection comprises a material comprising fixed internal angles. Such an "X" intersection connector comprises elastic, inelastic material and/or aforementioned mechanisms. For example, in a preferred embodiment, the "X" intersection connector comprises a material comprising fixed internal angles and the wearer is provided with an assortment of such connectors comprising different internal angles. In such an embodiment, the user selects the connector that provide for comfortable wear. Overall, a user is provided with a mechanism (or mechanisms) to adjust internal angles of the "X" intersection and/or "X" pattern. For example, when such a mechanism comprises a snap, the user adjusts the "X" intersection angles and then secures the snap through application of force. Once secured, the snap does not rotate as to allow changes in the internal angles of the "X" intersection and/or "X" pattern formed by the backside straps.

Figure 11:
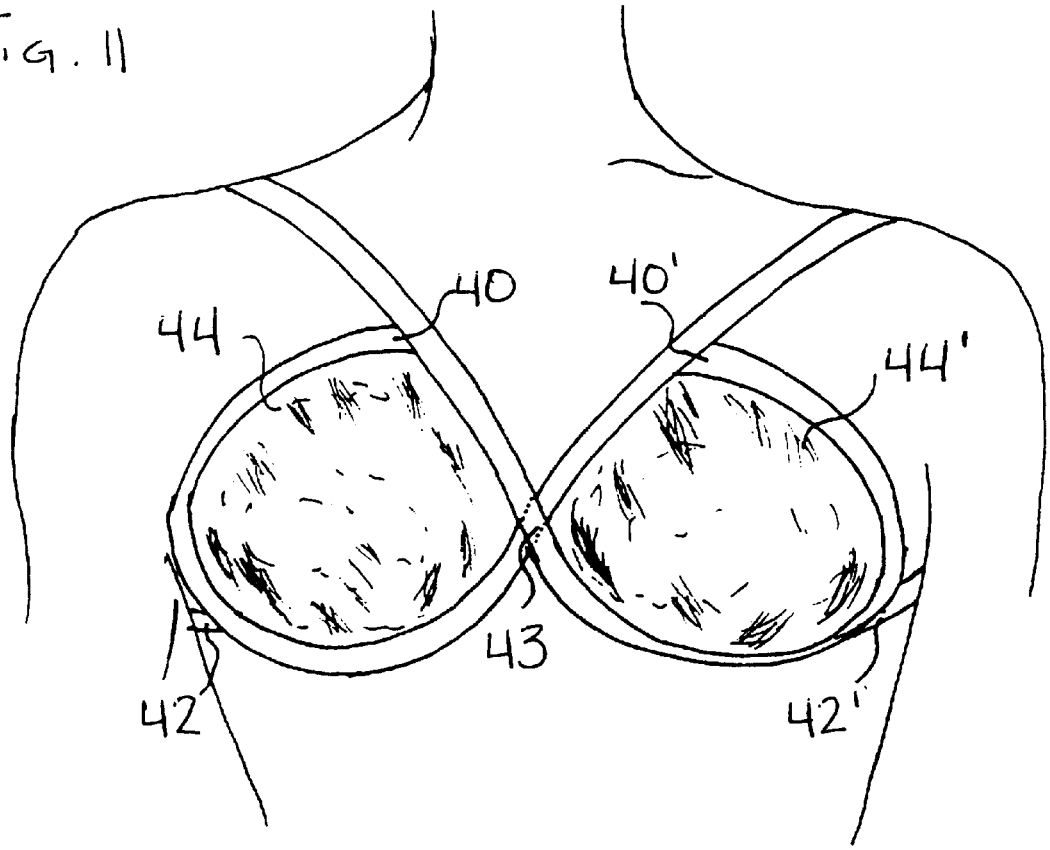
FIG. 11 is a front view of an alternative embodiment of the brassiere of the present invention.
Figure 12:
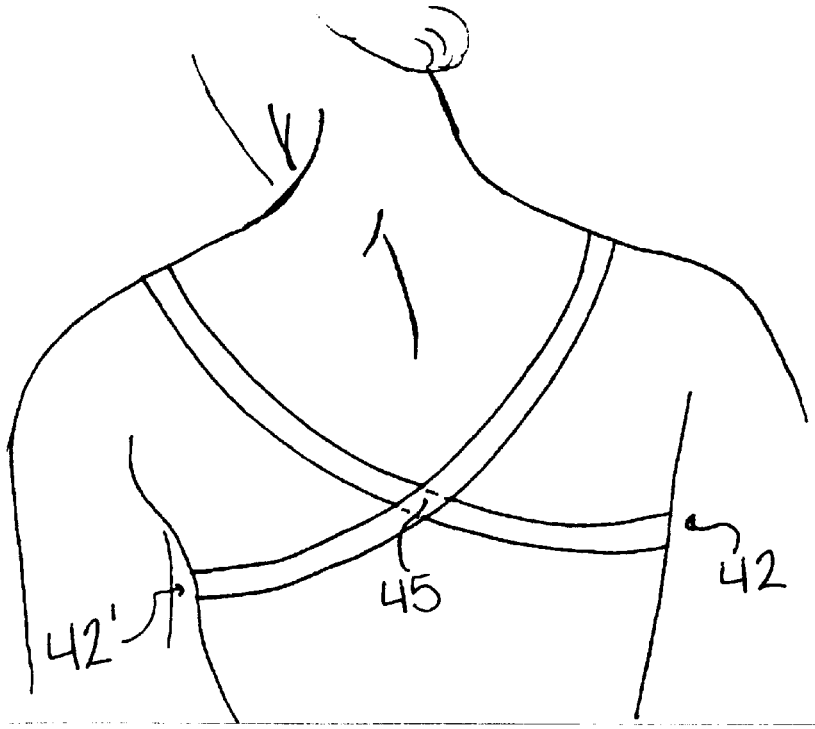
FIG. 12 is a rear view of the embodiment shown in FIG. 11.

FIG. 11 is a front view of another preferred embodiment of the brassiere of the present invention. This embodiment comprises two straps 40, 40'. Near the top of each breast cup 44, 44' a strap 40, 40' encircles part of a respective cup, follows a path around the bottom of the cup and then upwards to and over the opposite shoulder. The two straps cross at a point 43 located approximately between the two breast cups 44, 44'. The straps 40, 40' then cross each other on the wearer's backside at a point 45, shown in FIG. 12. After crossing, each strap proceeds to a point of attachment with itself and/or a breast cup 42, 42'. Of course, the straps of this embodiment are interruptible for connectors and/or adjusters.

Figure 13:
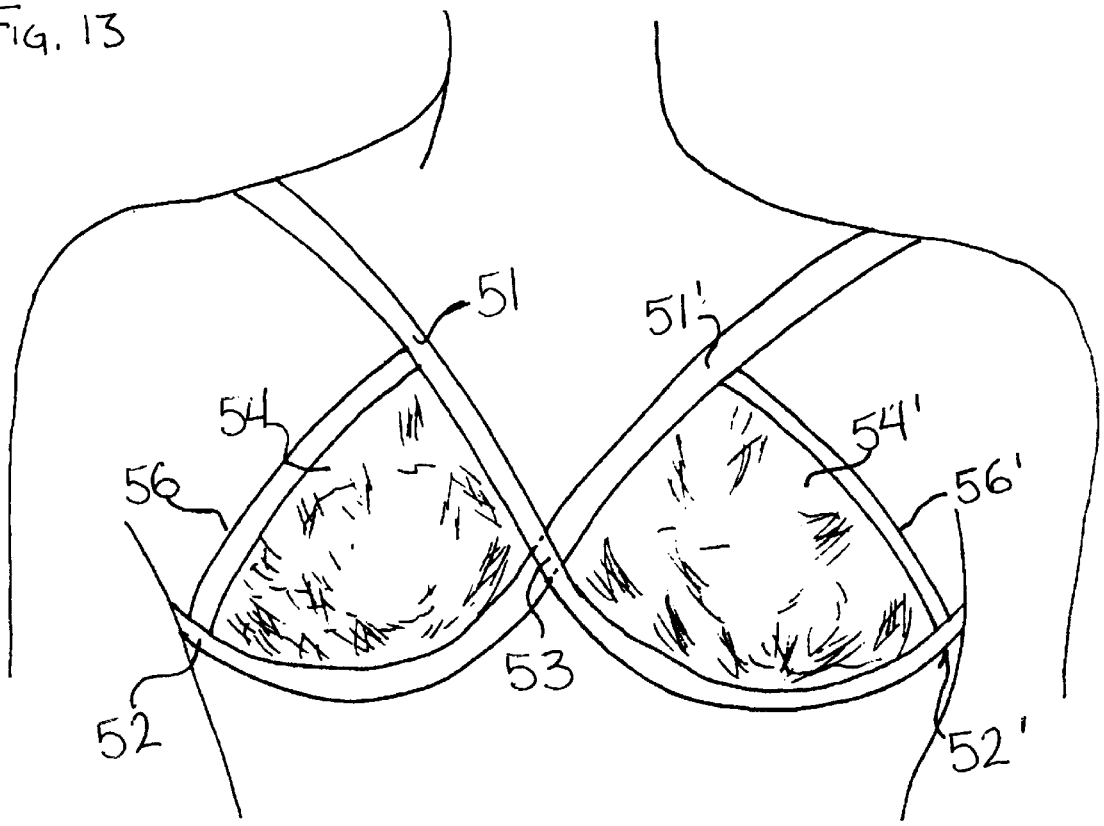
FIG. 13 is a front view of another alternative embodiment of the brassiere of the present invention.

FIG. 13 is a front view of a preferred embodiment of the brassiere of the present invention. This embodiment comprises four straps 51, 51', 56, 56'. Main straps 51, 51' cross at a point 53 approximately between the breast cups 54, 54'. The main straps 61, 51' also cross at a point on the wearer's backside. Each minor strap 56, 56' connects main straps 51, 51' along an outer edge of each breast cup 54, 54'. Each minor strap connection spans from a point near the top of a breast cup to a point near a lower, outer edge of a breast cup 52, 52'. Of course, the straps of this embodiment are interruptible for connectors and for adjusters.

Figure 14:
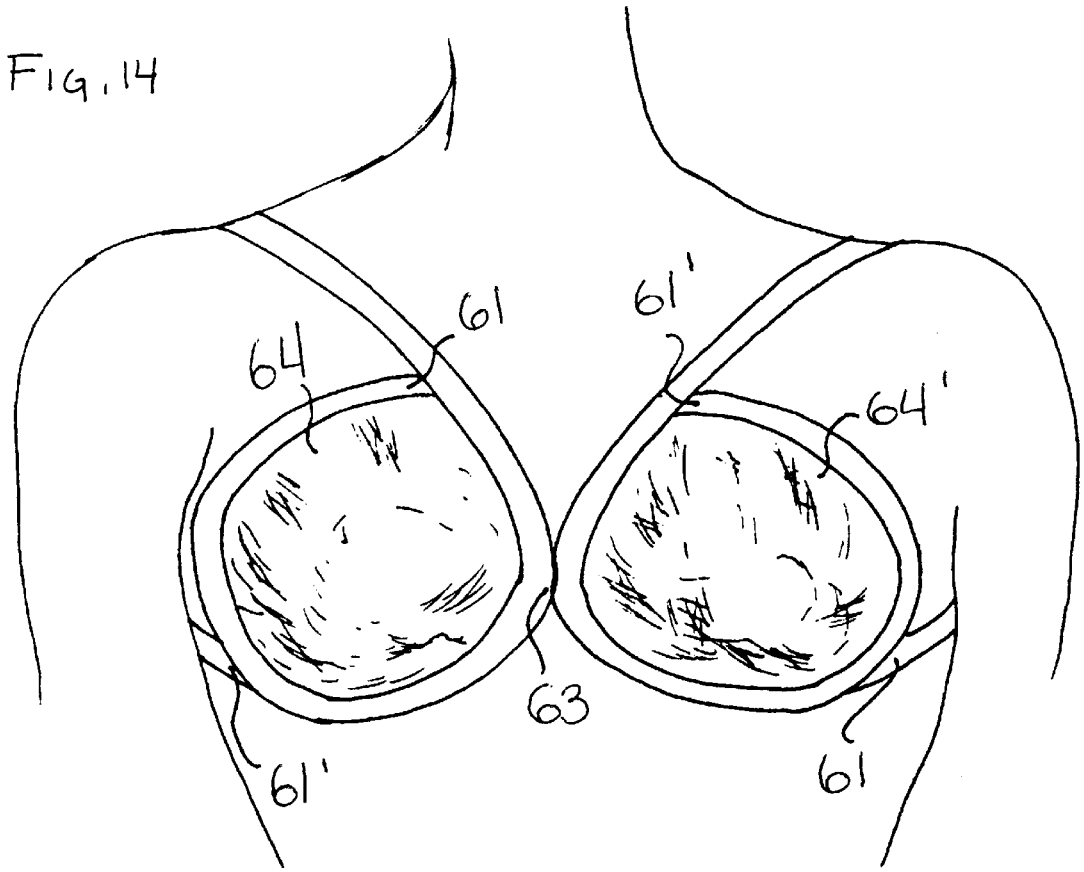
FIG. 14 is a front view of yet another alternative embodiment of the brassiere of the present invention.

FIG. 14 shows a preferred embodiment of a brassiere of the present invention. This embodiment comprises two straps 61, 61'. Each strap 61, 61' encircles a breast cup 64, 64'. The two straps meet at a point approximately between the two breast cups 64, 64'. The straps pass over the wearer's shoulders and cross on the wearer's backside at an "X" intersection. Each strap 61, 61' then passes under an arm of the wearer and attaches to a breast cup 64, 64' and/or the opposite strap. Of course, the straps of this embodiment are interruptible for connectors and/or adjusters.

Brassieres of the present invention comprise straps and/or breast cups comprising elastic material.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A brassiere comprising:

one strap comprising a two-loop figure eight pattern wherein each loop comprises an outer circumference and an inner circumference adjacent to a point wherein said strap crosses itself and wherein the wearer's arms are inserted one through each loop of the figure eight pattern;

two breast cups wherein each breast cup comprises an outer perimeter and wherein each of said breast cup outer perimeters are attached to said strap at a position selected from a member of the group consisting of along said loop outer circumference and along said loop inner circumference; and two additional straps attached along said outer perimeter of said breast cups.

2. The brassiere of claim 1 comprising at least one member selected from the group consisting of fasteners, underwires, connectors and adjustors.

3. The brassiere of claim 1 comprising at least one interruption of said strap and bridging of said at least one interruption by at least one connector.

4. A brassiere comprising:

two breast cups;

straps wherein said straps form an "X" pattern across the wearer's backside wherein said "X" pattern comprises internal angles; and a connector for fixing said internal angles of said "X" pattern, said connector comprising a snap mechanism.

5. The brassiere of claim 4 wherein said connector is adjustable by the wearer.

6. The brassiere of claim 4 wherein said connector is selectable by the wearer.

7. The brassiere of claim 4 wherein said connector is fixable by the wearer.

8. The brassiere of claim 4 wherein said connector comprises a piece of material.

* * * * *